US009121395B2

(12) United States Patent
Gray, Jr.

(10) Patent No.: US 9,121,395 B2
(45) Date of Patent: Sep. 1, 2015

(54) METHOD FOR ASSEMBLING A BENT-AXIS PUMP/MOTOR

(71) Applicant: Charles L. Gray, Jr., Pinckney, MI (US)

(72) Inventor: Charles L. Gray, Jr., Pinckney, MI (US)

(73) Assignee: The United States of America, as represented by the Administator of the U.S. Environmental Protection Agency, Washington, DC (US)

( * ) Notice: Subject to any disclaimer, the term of this patent is extended or adjusted under 35 U.S.C. 154(b) by 239 days.

(21) Appl. No.: 14/036,182

(22) Filed: Sep. 25, 2013

(65) Prior Publication Data

US 2015/0082631 A1 Mar. 26, 2015

(51) Int. Cl.

| | |
|---|---|
| ***F04B 1/20*** | (2006.01) |
| ***F04B 1/24*** | (2006.01) |
| ***F04B 53/22*** | (2006.01) |

(52) U.S. Cl.

CPC ..... *F04B 1/20* (2013.01); *F04B 1/2014* (2013.01); *F04B 1/2085* (2013.01); *F04B 1/24* (2013.01); *F04B 53/22* (2013.01)

(58) Field of Classification Search

CPC . B66B 11/0423; F01B 3/0041; F03C 1/0647; F04B 1/20; F04B 1/2014; F04B 1/2085; F04B 1/24; F04B 53/22; F04B 1/2007; Y10T 29/49799; Y10T 29/49904

See application file for complete search history.

(56) References Cited

U.S. PATENT DOCUMENTS

2015/0030471 A1* 1/2015 Miyata et al. ..... 417/269

* cited by examiner

*Primary Examiner* — Alexander P Taousakis
(74) *Attorney, Agent, or Firm* — David H. Read

(57) ABSTRACT

A rotating group of a bent-axis axial piston pump/motor is assembled as a subassembly with a removable stabilizing component that holds together and compresses the subassembly while it is outside of the pump/motor case. A yoke that carries a permanent or attachable back plate is installed in the case and positioned aside to allow clearance for installation of the rotating group. After the rotating group is installed, the yoke is moved back into proximity with the barrel, the stabilizing component is removed, and the remaining connections are completed.

6 Claims, 4 Drawing Sheets

METHOD FOR ASSEMBLING A BENT-AXIS PUMP/MOTOR

CROSS-REFERENCE To RELATED APPLICATION

This application claims priority to U.S. provisional patent application 61/707,104, "Low Cost Production Design and Method for Assembling a Bent-Axis Pump/Motor," filed Sep. 28, 2012.

BACKGROUND OF THE INVENTION

1. Technical Field

The disclosed embodiments are directed generally to the production and assembly of a bent-axis hydraulic, pump or motor having a case and a rotating group.

2. Description of the Related Art

Bent-axis axial piston hydraulic pumps and motors (which will be collectively referred to herein as pump/motors, but with the intent to encompass both bent-axis axial piston pumps and motors even if such may be used primarily or exclusively in applications as solely a pump or motor without reversible operation) are employed in hydraulic hybrid vehicles as Weil as other hydraulic devices. Such pump/motors typically include a rotating group that comprises several rotating components, such as a power shaft, a barrel, a plurality of working pistons reciprocating within bores in the barrel, a tripod between the barrel and power shaft, and a drive plate that connects the working pistons to the power shaft. The rotating group normally resides within a stationary pump motor case which is provided with fluid supply connections and arcane for installation in a vehicle or other device.

In modern manufacturing systems it is often advantageous to assemble a device as a group of two or more subassemblies, with each subassembly being assembled in a different location and then transported to a final assembly location. The different locations may be within the same factory, which may require hand carrying or transportation by shop cart, or in different buildings or different countries, which requires more robust packaging and transportation. However, for hydraulic pump/motors, although there may be benefits in assembling a rotating group as a subassembly, many of the individual parts of a rotating group are only loosely held together and will easily come apart when outside of a pump/motor case, making it difficult to handle or transport as a subassembly. For these reasons, the rotating group is commonly assembled piece by piece within the pump/motor case. This limits flexibility on the assembly line by tying up the pump/motor case assembly for a longer time while the intricate parts of the rotating group are painstakingly placed into the ease one part at a time.

OBJECT OF THE INVENTION

It is therefore an object of the invention to provide a method for more convenient and inexpensive production and assembly of a bent-axis pump/motor.

SUMMARY OF THE INVENTION

The invention is a production design and method for low-cost fabrication and assembly of a bent-axis pump/motor, in which the rotating group is assembled separately from the case and held together by a removable stabilizing component. The preferred embodiment applies to an over-center yoke-based design, but the invention can also be applied to non-over-center designs as well as those with a removable back plate.

In particular, as the rotating group is assembled, a removable stabilizing component, such as a rod, wire, or other longitudinal member, is employed to hold together and compress the rotating group components and allow for their transport and installation as a subassembly. In an over-center yoke-based pump/motor, or in a single-sided yoke-based pump/motor, yoke components are installed into the case, and then the yoke is swung aside to an extreme position. With the yoke out of the way, the preassembled and stabilized rotating group is then installed into the case. The yoke is then moved back to a zero displacement position, the stabilizing component is removed, and the connections between the rotating group and the yoke are completed. Alternatively, if the portion of the yoke containing the hack plate is configured to be detachable from the yoke leg(s), that portion is not installed until after the rotating group has been installed, and the yoke need not be swung out of the way.

DETAILED DESCRIPTION OF THE INVENTION

Figure 1:
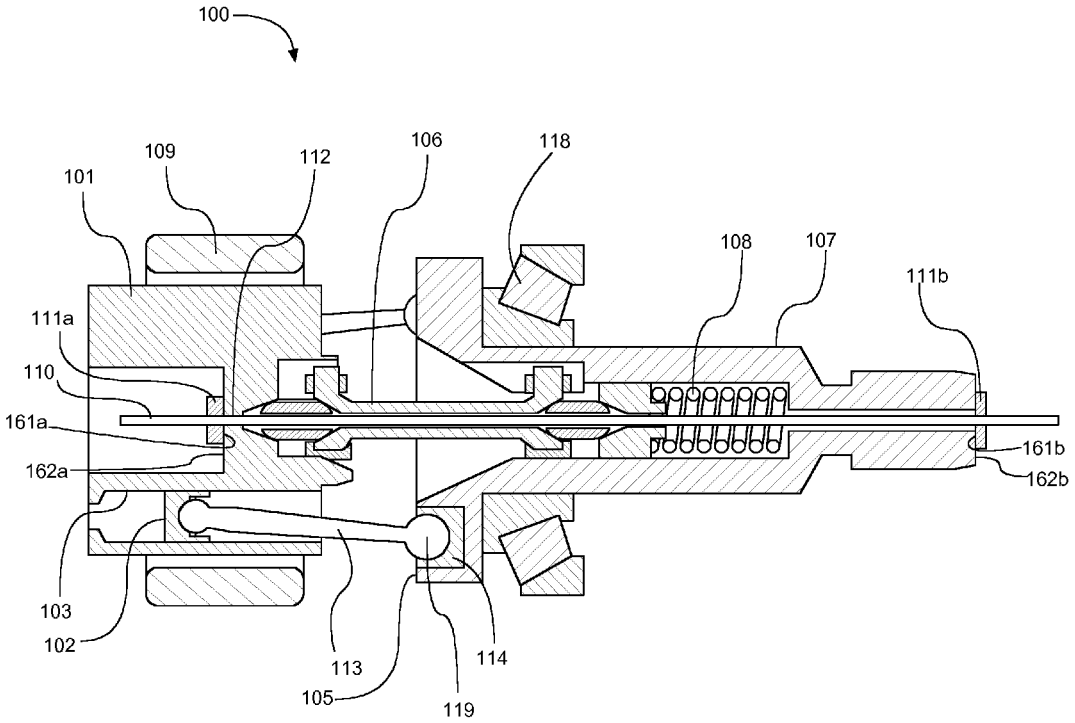
FIG. 1 is a sectional view of a rotating group showing selected components held together by a removable stabilizing, assembly rod.

Referring to FIG. 1, a rotating group 100 of a bent-axis axial piston pump/motor is shown. Ordinarily, rotating group 100 would be installed in a pump/motor case (not shown) that provides the necessary bearing surfaces for shaft 107 as well as fluid supply means. As is familiar in the bent-axis pump/motor art. barrel 101 contains a plurality of bores 103 in which pistons 102 reciprocate. Baud 101 is configured to move ("articulate") with respect to shaft 107 to change displacements in the known way that is characteristic of bent-axis pump/motors. Tripod 106 resides between barrel 101 and shaft 107, causing the three parts to rotate together even as the barrel and shaft articulate. Spring 108 provides a degree of compressive force to help the parts remain in contact when installed in a pump/motor case. As is commonly understood, a tripod design such as 106 provides only a rotational linkage, and is not positively retained by either the barrel 101 or the shaft 107, and therefore will not prevent the barrel and shaft from coming, apart when the assembly is outside of the case. Further, pistons 102 are not positively retained in bores 103 when the assembly is outside of the case. Therefore, to assemble rotating group 100 independently of its case requires that the parts be held together by sonic means so that they can be conveniently handled. transported and assembled without coming apart.

According to a feature of the invention, assembly rod 110 passes through the center of the rotating group assembly, holding the components together and providing some structural rigidity to prevent articulation while the assembly is outside of the case. In one embodiment of the invention, as shown in FIG. 1, collars 111*a* and 111*b*, preferably in the form of threaded nuts, are engaged to rod 110 (alternatively, collars 111*a* and/or 111*b* could be engaged with the rod by clamping or other means). When either or both nuts are advanced (e.g., turned) toward the other, surface 161*a* of nut 111*a* bears against surface 162*a* of barrel 101, while surface 161*b* of nut 111*b* bears against surface 162*b* of shaft 107, placing rod 110 in tension and therefore exerting a retentive force that prevents barrel 101 from separating from the shaft 107 or from articulating with respect to the shaft. Stiffness of rod 110 also provides additional resistance against articulation, although the rod 110 does not need to be particularly strong to serve the purpose. Further tightening of either of nuts 111*a,b* acts to compress spring 108. reducing the overall length of the rotating group as needed to facilitate installation (as discussed later). Alternatively, it is not necessary for both nuts 111*a* and 111*b* to be positionable (e.g. by being threaded) along the rod, as one could be fixedly attached to the rod as long as the other is positionable.

In an alternative embodiment, instead of nut 111*a* bearing against the inner surface of barrel 101, a threaded connection could be made between assembly rod 110 and barrel rod bore 112 through which it passes. A similar threaded connection with the shaft could alternatively replace nut 111*b*. Also alternatively, because rod 110 acts primarily in tension, it could be replaced with a flexible wire or similar structure that could be placed in tension by any known means, such as a turnbuckle, wire tensioner, or similar device attached to or gripping the wire and bearing against either surface 162*b* (preferably) or 162*a*.

Figure 2:
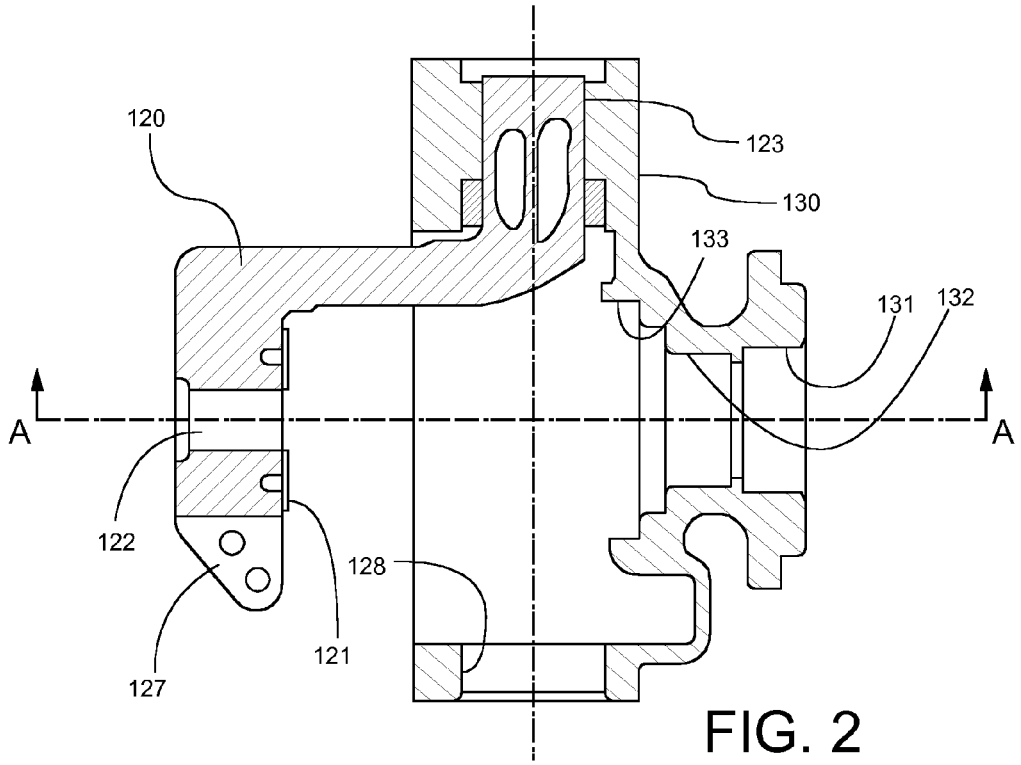
FIG. 2 is a sectional view of a pump/motor case with a yoke installed in the case.
Figure 3:
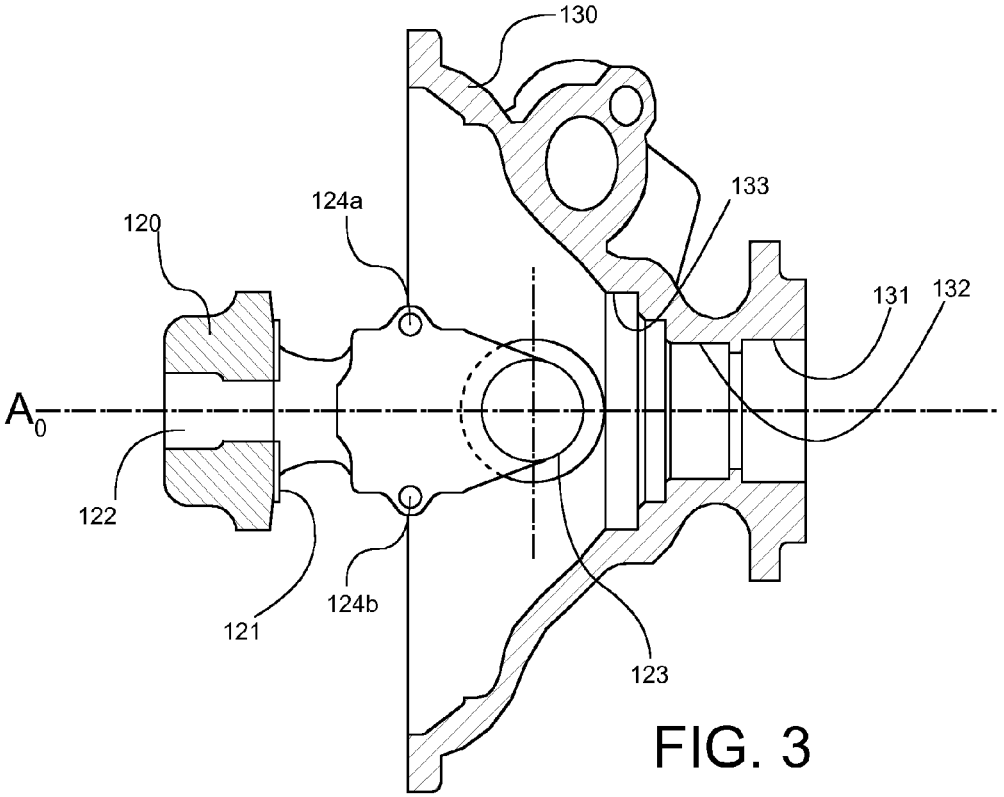
FIG. 3 is a sectional view of the pump/motor case of FIG. 2 taken at section A-A.

Referring now to FIGS. 2 and 3, pump/motor case 130 (approximately one half of which is shown, not including the portion which covers the yoke swing path) houses yoke leg 120 which pivots about yoke pivot hearing 123. Yoke leg 120 includes fluid passages (not shown) which conduct working fluid between hack plate 121 and yoke pivot 123. Low pressure fluid is conducted through other openings (not shown) in fluid communication with the fluid filled interior of case 130. Preferably, a second non-fluid-conducting (i.e., only structural) yoke leg (not shown) connects at flange 127 to second pivot bearing 128. Alternatively, both yoke legs could be fluid conducting as is known in the art. Also, although it is seen that the example provided in the figures is an over-center pump/motor in which the yoke may pivot to positive and negative quadrants with respect to the zero angle position $A_0$, the invention is also applicable to a single-sided pump/motor in which the yoke pivots into only one quadrant.

Figure 4:
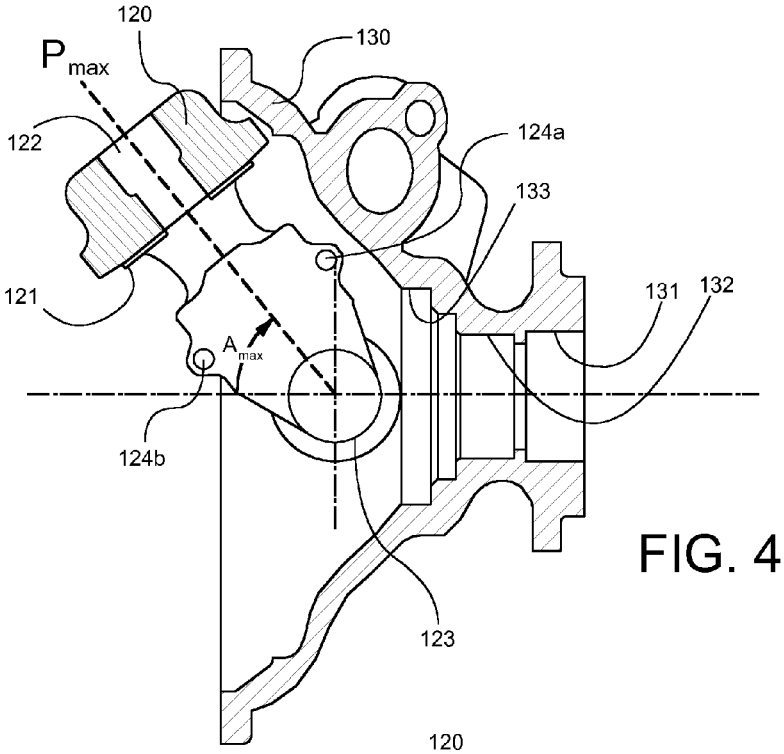
FIG. 4 is a sectional view of the pump/motor case with the yoke swung aside to art extreme position.
Figure 5:
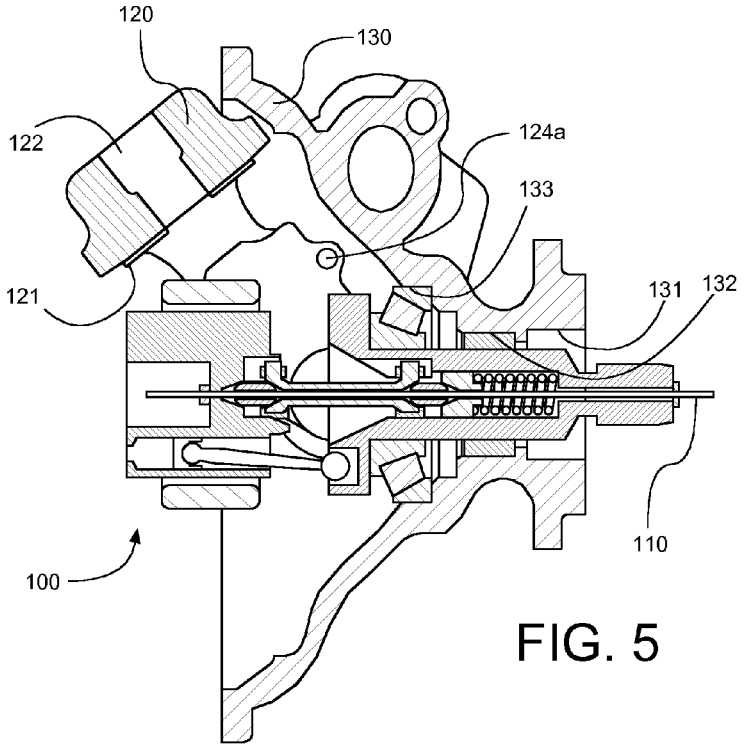
FIG. 5 is a sectional view showing the rotating group of FIG. 1 installed into the pump/motor case.

In FIG. 3, yoke 120 is shown at a zero displacement position at is zero degree angle ($A_0$) with the shaft bore in an over-center pump/motor unit In FIG. 4, yoke 120 has been pivoted to a maximum angle $A_{max}$ (to yoke position $P_{max}$), allowing unobstructed access to the case interior from the yoke side of the case (as depicted, the left side). In FIG. 5, according to the invention, rotating group 100. stabilized by assembly rod 110, has been installed onto bearing surfaces 131-133 from the yoke side of the ease while yoke 120 is at position $P_{max}$.

Figure 6:
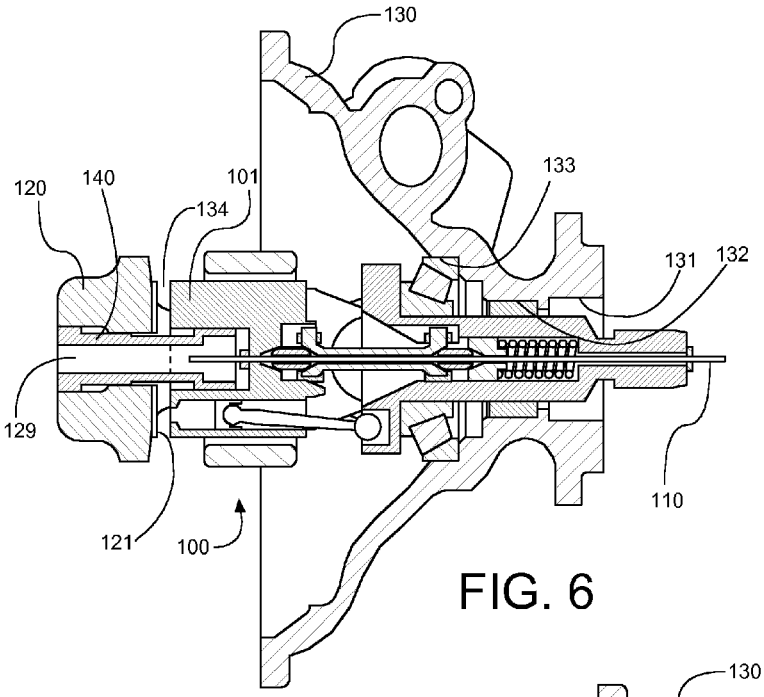
FIG. 6 shows the yoke swung back to a zero displacement position prior to completion of the assembly.
Figure 7:
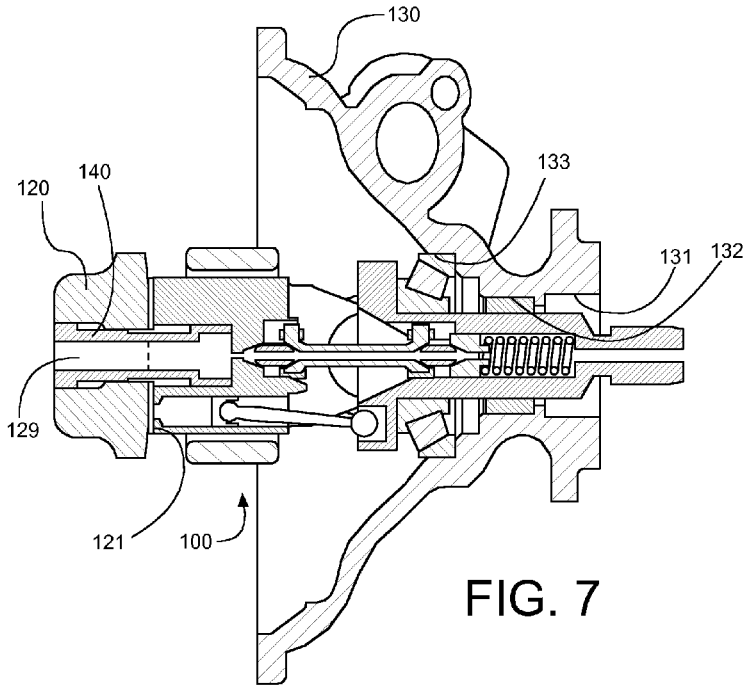
FIG. 7 shows the assembly rod removed, allowing the rotating group to uncompress and the barrel to be connected to the yoke.

Completion of assembly includes connection of back plate 121 to barrel 101 by means of center post 140 (FIGS. 6 and 7). This requires yoke 120 (in particular, hack plate 121) and barrel 101 to be brought into proximity and properly aligned. However, in order for back plate 121 to clear the outer end of barrel 101 (with which it is normally in contact when assembled), the overall length of the rotating group must be temporarily shortened so that the barrel is moved slightly inward toward the yoke pivot. Accordingly, assembly rod 110 is installed with sufficient tension to compress spring 108 and thereby reduce the overall length of rotating group 100, creating clearance 134 (FIG. 6). The amount of tension necessary depends on the strength of spring 108 and the specific geometries of the yoke, back plate, and barrel, but can be set at whatever amount is necessary to provide adequate clearance.

In FIG. 7, back plate 121 and barrel 101 have been brought into contact, eliminating clearance 134 of FIG. 6. This is achieved by release of nut 111*a* and/or 111*b* (or, in the alternative embodiment, unscrewing the threaded portion of rod 110 from barrel rod bore 112), whereupon the tension is released and spring 108 expands. Once barrel 101 is in or near contact with back plate 121, center post 140 may be installed to full depth, preferably by thermal or press fit, so as to rotatably mount barrel 101 on yoke 120, against back plate 121.

As can be seen in FIGS. 4 and 5, the pump/motor case 130 must be fabricated with sufficient clearances so that when yoke 120 is moved to its maximum angular position, rotating group 100 can be installed into pump/motor case 130 without interference with the yoke 120 and back plate 121. Alternatively, yoke 120 can be fabricated with the portion holding the back plate being detachable from the leg, so that rotating group 100 could be installed in pump/motor case 130 without the need to pivot yoke 120.

Accordingly, a preferred assembly process for a bent-axis pump/motor according to the invention includes the steps of (1) assembling a rotating group that includes a removable. stabilizing component for stabilization of the assembly when outside of case: (2) installing at least one yoke leg (which includes a back plate surface) into the case; (3) positioning the yoke leg at an angle at which it does not obstruct access to the shaft axis of the case (preferably at or near a maximum yoke angle $A_{max}$); (4) installing the rotating group, with the stabilizing component installed, into the case; (5) moving the yoke into alignment with the rotating group (preferably at or near a zero degree yoke angle $A_0$); (6) inserting the center post to initially axially align the rotating group and the yoke; (7) removing the stabilizing, component, thus causing the barrel of the rotating group to contact or nearly contact the back plate; and (8) completing installation of the center post to firmly connect the back plate with the barrel (preferably by thermal or press fit, but alternatively by other means such as, for example, threading, bolting, or surface bonding).

The application is intended to be limited solely by the claims hereto.

The invention claimed is:

1. A method for assembling a hydraulic, pump/motor rotating group, comprising:

assembling a rotating group that includes a barrel and a shaft; wherein the assembling includes the installation of a removable stabilizing component that passes through the longitudinal axes of the barrel and shaft; and wherein the removable stabilizing component includes a longitudinal member configured to provide axial load on the barrel and on the shaft;

tensioning the longitudinal member so as to cause the barrel and shaft to be retained in longitudinal proximity and to limit them from articulating with respect to each other.

2. The method of claim 1, wherein the longitudinal member has at least one contact surface that is longitudinally positionable along the member, for contact with the rotating group.

3. The method of claim 1, wherein the longitudinal member is a narrow rod with first and second bearing surfaces for bearing upon respective first and second opposing surfaces, and wherein one opposing surface is on the barrel and the other opposing surface is on the shaft.

4. The method of claim 3, wherein the first and second hearing surfaces are provided by respective first and second collars positioned near respective first and second ends of the member, and at least one of said first and second collars is longitudinally movable along the member.

5. A method for assembling a hydraulic pump/motor rotating group into a case, comprising:

assembling a rotating group that includes a barrel and a shall; wherein the assembling includes the installation of a removable stabilizing component that passes through the longitudinal axes of the barrel and shaft; and wherein the removable stabilizing component includes a longitudinal member;

tensioning the longitudinal member so as to cause the barrel and shaft to be retained in longitudinal proximity and be prevented from articulating with respect to each other;

longitudinally compressing the rotating group to shorten its length;

installing into the case a yoke that includes a permanent or attachable back plate;

positioning the yoke to provide clearance for installation of the rotating group;

installing the rotating group into the case;

positioning the yoke into proximity with the barrel of the rotating group;

removing the removable stabilizing component; and connecting the back plate with the barrel of the rotating group.

6. The method of claim 5, wherein the tensioning step is performed by longitudinally adjusting the longitudinal member.

* * * * *